US007828915B2

(12) United States Patent
Lee et al.

(10) Patent No.: US 7,828,915 B2
(45) **Date of Patent: *Nov. 9, 2010**

(54) METHOD FOR MAKING MG-BASED INTERMETALLIC COMPOUND

(75) Inventors: Sheng-Long Lee, Jhongli (TW); Jing-Chie Lin, Jhongli (TW); Che-Wei Hsu, Jhongli (TW); Cheng-Yu Chou, Jhongli (TW); Yin-Chun Cheng, Jhongli (TW); Chia-Wang Weng, Jhongli (TW); Chien-Chang Chiang, Jhongli (TW); Chien-Wei Chen, Jhongli (TW)

(73) Assignee: National Central University, Taoyuan (TW)

( * ) Notice: Subject to any disclaimer, the term of this patent is extended or adjusted under 35 U.S.C. 154(b) by 428 days.

This patent is subject to a terminal disclaimer.

(21) Appl. No.: 11/953,821

(22) Filed: Dec. 10, 2007

(65) Prior Publication Data

US 2009/0116992 A1 May 7, 2009

(30) Foreign Application Priority Data

Nov. 5, 2007 (TW) ..... 96141715 A

(51) Int. Cl.
*C22F 1/10* (2006.01)

(52) U.S. Cl. ..... 148/555; 148/409; 164/57.1

(58) Field of Classification Search ..... 148/555, 148/409; 164/57.1
See application file for complete search history.

(56) References Cited

U.S. PATENT DOCUMENTS 7,648,598 B2 * 1/2010 Lee et al. ..... 148/555

* cited by examiner

*Primary Examiner*—George Wyszomierski
*Assistant Examiner*—Weiping Zhu
(74) *Attorney, Agent, or Firm*—Chun-Ming Shih

(57) ABSTRACT

A method for making Mg(magnesium)-based intermetallic compound uses a thermal process during a melting process to produce largely the Mg-based intermetallic compound. The vapor pressure of Mg is high, thereby Mg is prone to be vaporized from a melt and a wrought solid alloy in the melting process of high temperature, for purifying the wrought Mg-based intermetallic compound. The method may simplify the process and devices for making the Mg-based intermetallic compound, and produce efficiently a larger of high purity Mg-based intermetallic compound.

8 Claims, 4 Drawing Sheets

METHOD FOR MAKING MG-BASED INTERMETALLIC COMPOUND

FIELD OF THE INVENTION

The present invention relates to methods for making Mg (magnesium)-based intermetallic compound, and particularly, to a method for making Mg-based intermetallic compound, which can efficiently melt, make, and purify the Mg-based intermetallic compound. The method thermally treats it since Mg is prone to be vaporized, for efficiently producing the Mg-based intermetallic compound.

DESCRIPTION OF THE RELATED ART

Mg-based intermetallic compound is a typical alloy, which is made by employing Mg as a substrate to cooperate with a second element. The Mg-based intermetallic compound has a typical crystal structure and typical uses corresponding thereto, thus it is now widely studied. The Mg-based intermetallic compound (e.g., $Mg_2Ni$, $Mg_2Cu$, etc.) is made by mainly cooperating with Ni (nickel), Cu (copper) to be served as a hydrogen storage alloy configured for storing hydrogen. The Mg-based intermetallic compound has an antifluorite structure, thereby it is widely studied and used in semiconductor films, electrodes of lithium ion batteries, electrode materials of nickel-metal hydride batteries, and new-style conducting materials. The above metal is called as a functional Mg-based intermetallic compound.

Many experiments prove that the purity of the Mg-based intermetallic compound will influence greatly the characteristic of the reaction. Furthermore, the Mg-based intermetallic compound is produced in hard melting areas in the plane phase diagram of the metallurgy. The composite range thereof is not a wide and stretch composite range same as conventional alloys, but a linear and precise composite range. That is called as the peritectic reaction of the metallurgy. Mg has a high vapor pressure and is prone to be vaporized, thereby even if the original material has a precise composite range, Mg is lost in a temperature rise process to result the material losing the precise composite range of the peritectic reaction. The melted product will includes an eutectic structure (a mixed phase comprised of residue Mg and the Mg-based intermetallic compound), therefore, it is has a nonuniform composite, and a bad purity. Those will greatly influence the characteristics of the Mg-based intermetallic compound, such as capabilities of storing hydrogen, electricity, heat conducting.

Conventional methods for making the Mg-based intermetallic compound include arc melting methods, combustion synthesis methods, power metallurgy methods, laminate rolling methods, mechanical alloying method, and rotation-cylinder methods, etc. The above methods have many disadvantages, such as need of expensive devices, spending more manufacturing time and lower output. Furthermore, the above methods are prone to produce a mixed eutectic composite comprised of the Mg—Ni structure and the $Mg_2Ni$ alloy having γ phase. The impurity thereof cannot be efficiently removed to obtain the high pure $Mg_2Ni$ alloy having γ phase.

In addition, in a conventional art, pure Mg powder and pure Ni powder are selected to be mechanically milled since obtaining the $Mg_2Ni$ alloy is difficult to be achieved. The product is still mainly Mg and Ni during the initial hours. Then the pure Mg and the pure Ni are lost gradually, and Mg—Ni alloy instead of the $Mg_2Ni$ alloy having diffractive peak, begins to be formed after 26 hours. Later, the $Mg_2Ni$ alloy having X-ray diffractive peak is formed after 66 hours.

The conventional art discloses to obtain the high pure Mg-based alloy ($Mg_2Ni$) having γ phase by milling. However, it needs to spend a very long manufacturing time, and the milling device needs to be used for a long time. Therefore, the cost is high and difficult to be reduced greatly.

Another conventional art discloses an electrochemical film switch material. The electrochemical film switch material is changed when absorbs the hydrogen. One of the electrochemical films switch material is the $Mg_2Ni$ film. The method includes depositing an Mg film and a Ni film by the vacuum sputtering, then annealing them in a nitrogen gas at 125-centigrade degrees to obtain partly Mg-based (Mg2Ni) alloy. However, the output of the above method is few, and the method needs a long time. Furthermore, the product is not the highly pure Mg-based ($Mg_2Ni$) alloy.

Another conventional arts disclose to employ jet casting methods, melt spinning methods, gas atomization methods, and planar flowcasting methods, etc., to make the Mg—Ni alloy. However, the composite cannot be efficiently controlled. The mole ratio of Mg and Ni may be from 1:1 to 2:1. That is, these conventional arts still cannot obtain the high pure Mg-based ($Mg_2Ni$) alloy.

Still another conventional art employs a rotation cylinder method. The method is mainly configured for making composite materials originally, and is used for melting alloys having two large-different melting points latterly. Therefore, the method may be used for making the Mg—Ni alloy, and the weight percentage of Mg is in a range of 1-10. That is, the method still cannot obtain the highly pure Mg-based alloy ($Mg_2Ni$).

For obtaining the high pure Mg-based intermetallic compound, it is generally to be produced by the mechanical milling method. However, the mechanical milling method only can produce several grams product, and the maximal output thereof is several decade grams in 30 to 50 hours. Furthermore, the produced alloy is prone to be polluted by the steel sphere for mechanically milling in the long time, thereby, the method is not suitable for large demand and for using in the industry and consumer applications. Accordingly, a new method for manufacturing the Mg-based intermetallic compound is needed to further accelerate the industry development and advancement.

BRIEF SUMMARY

Since the conventional methods for manufacturing the Mg-based intermetallic compound have many disadvantages, for example, the manufacturing devices are expensive, the manufacturing time is long or the manufacturing output is low, the inventors of the present invention research and experiment for a long time, and then invent a method for making the Mg-based metal matrix composite based on their relating experience.

A method for making a Mg-based intermetallic compound in accordance with a preferred embodiment of the present invention, includes making a predetermined material to form a block mix of an initializing crystal of the Mg-based intermetallic compound and an eutectic structure (a mixing phase of the remained Mg and the Mg-based intermetallic compound) by a melting method, then maintaining temperature or rising temperature to perform an evaporating process since the Mg material is prone to be evaporated, for achieving a high pure Mg-based intermetallic compound quickly and largely. Furthermore, the present method may add a little third material (such as, Al, Fe, Zr, Ti, Cu, Pd, Pt and Ag, etc.) to change the quality and structure thereof for being researched or applied. Thus the present invention is valuable in the relating industry (such as, corporations for applying hydrogen, corporations for manufacturing semiconductor, thermal electronic power corporations, etc.).

Other objects, advantages and novel features of the invention will become more apparent from the following detailed description when taken in conjunction with the accompanying drawings, in which:

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Reference will now be made to the drawings to describe a preferred embodiment of the present method for manufacturing Mg-based intermetallic compound, in detail.

Figure 1:
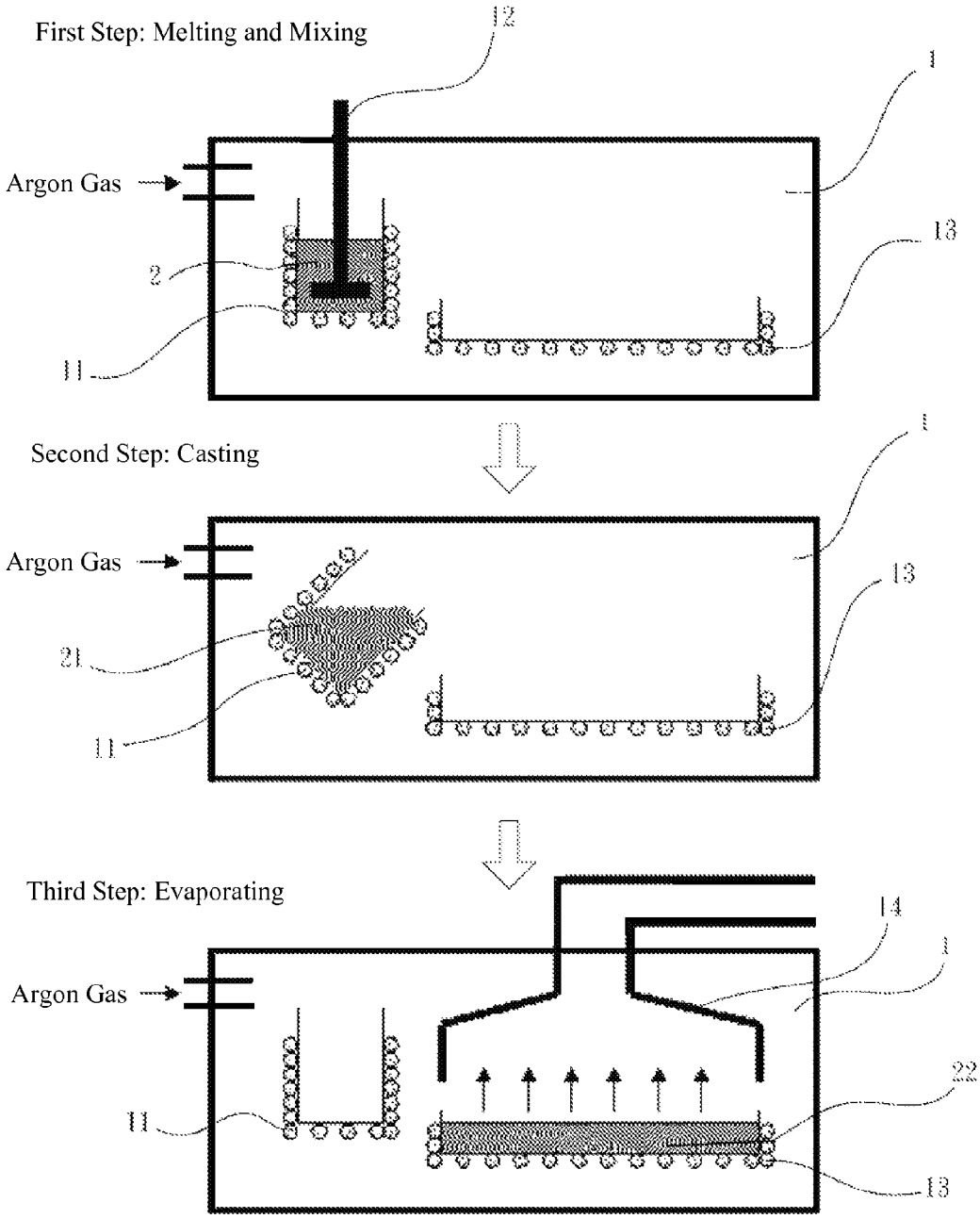
FIG. 1 is a schematic view of a preferred embodiment, showing main steps and melting devices.

Referring to FIG. 1, a method for making Mg-based intermetallic compound, in accordance with a preferred embodiment of the present invention, is shown. The method includes a first step of melting and mixing, a second step of casting, and a third step of evaporating.

The first step of melting and mixing employs a first heating furnace 11 to melt and mix a predetermined material 2 (selected from a group consisting of a block, a power material, and a porous material) in an airtight chamber 1 filled the inert gas 1, such as, argon gas (Ar), etc., therein. The amount of the predetermined material 2 does not need to be controlled accurately according to the making Mg-based intermetallic compound, it only needs to include excessive Mg material to be in the first heating furnace 11 during the melting process. The predetermined material 2 is melted at a high temperature of 800 to 850 centigrade degrees, and is mixed by a mixing device 12 for two hours. The second material having high melting point, such as Ni (1455 centigrade degrees), Cu (1085 centigrade degrees), Si (1410 centigrade degrees), etc., has been dissolved sufficiently in the large amount of Mg melt with a lower melting point to form an uniform melt 21 (as shown in the second step).

The second step of casting is casting the uniform melt 21 on a second heating furnace 13. The second heating furnace 13 is designed to be a thin and long flat plate to accelerate the following Mg vapor diffusing.

The third step of evaporating rises or maintains the temperature after casting, to make whole alloy above the eutectic temperature, such as 506-centigrade degrees for $Mg_2Ni$, 485-centigrade degrees for $Mg_2Cu$, 637-centigrade degrees for $Mg_2Si$, and 561-centigrade degrees for $Mg_2Sn$, for evaporating efficiently the remained Mg material. The mole percentage of the alloy will gradually be changed to correspond to the perfect peritectic reaction. The melting point of the Mg-based intermetallic compound is higher than the eutectic temperature thereof, thereby the formed Mg-based intermetallic compound will exist steadily. The large amount of high pure Mg-based intermetallic compound 22 may be achieved after rising or maintaining the second heating furnace 13 to evaporate the remained Mg material and then decreasing the temperature.

Figure 2:
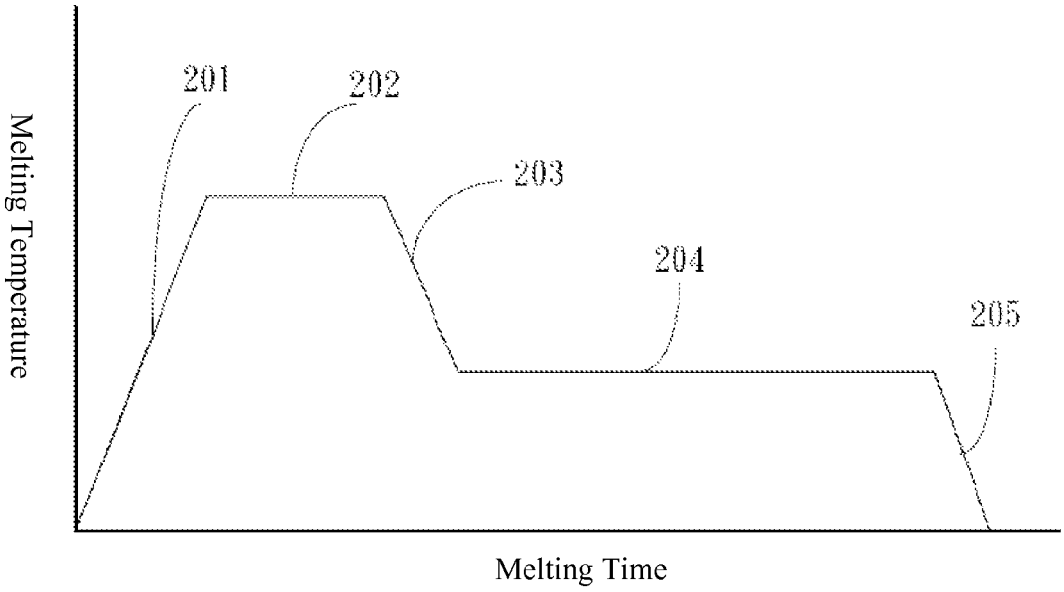
FIG. 2 shows a melting temperature ladder graph, for not rising temperature in an evaporating and purifying a Mg material of the present invention.
Figure 3:
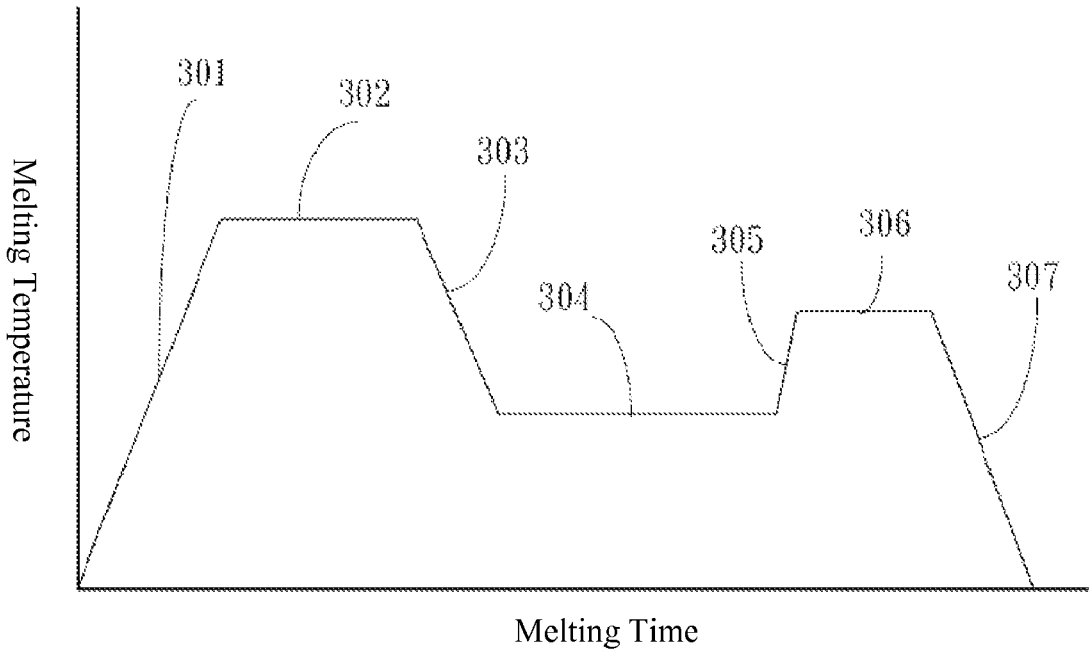
FIG. 3 shows a melting temperature ladder graph, for rising temperature in an evaporating and purifying a Mg material of the present invention.

Referring to FIGS. 2 and 3, melting temperature gradient graphs for no-rising temperature and re-rising temperature processes during purifying the Mg material of the present invention are shown. FIG. 2 shows processes includes a rising temperature process 201 before melting, a maintaining temperature process 202 in melting, a decreasing temperature process 203 in casting, a maintaining temperature process 204 in evaporating, and a decreasing temperature process 205 after evaporating. FIG. 3 shows processes including a rising temperature process 301 before melting, a maintaining temperature process 302 in melting, a decreasing temperature process 303 in casting, a maintaining temperature process 304 in evaporating, a rising temperature process 305 in the maintaining temperature process, a high temperature evaporating process 306 and a decrease temperature process 307 after evaporating. From FIGS. 2 and 3, a simple maintaining temperature process (the maintaining temperature process 204 in evaporating) is performed on the second heating furnace 13 in FIG. 2. It costs a long time for evaporating the Mg material, thus, a re-rising temperature process (the rising temperature process 305 in the maintaining temperature process) as shown in FIG. 3, may be performed on the second heating furnace 13. Since the Mg material is evaporated directly proportionally to the temperature, the rising process can decrease efficiently the time for purifying.

The mole percentage of the Mg-based intermetallic compound may be a mole percentage of an Mg-based intermetallic compound produced by the peritectic reaction in an Mg-based plane phase graph.

The third step of evaporating is performed between the eutectic reaction and the melting point of the produced Mg-based intermetallic compound.

A third material selected from a group consisting of Al, Fe, Zr, Ti, Cu, Pd, Pt and Ag may be added during rising melting process in the third step of evaporating to change the material and the structure thereof.

A third material selected from a group consisting of Al, Fe, Zr, Ti, Cu, Pd, Pt and Ag may be added on the second heating furnace 13 during the decreasing temperature process in the second step of casting.

The third material selected from a group consisting of Al, Fe, Zr, Ti, Cu, Pd, Pt and Ag may be added during the maintaining temperature process in the third step of evaporating.

The third material selected from a group consisting of Al, Fe, Zr, Ti, Cu, Pd, Pt and Ag may be added during rising temperature process in the third step of evaporating.

Figure 4:
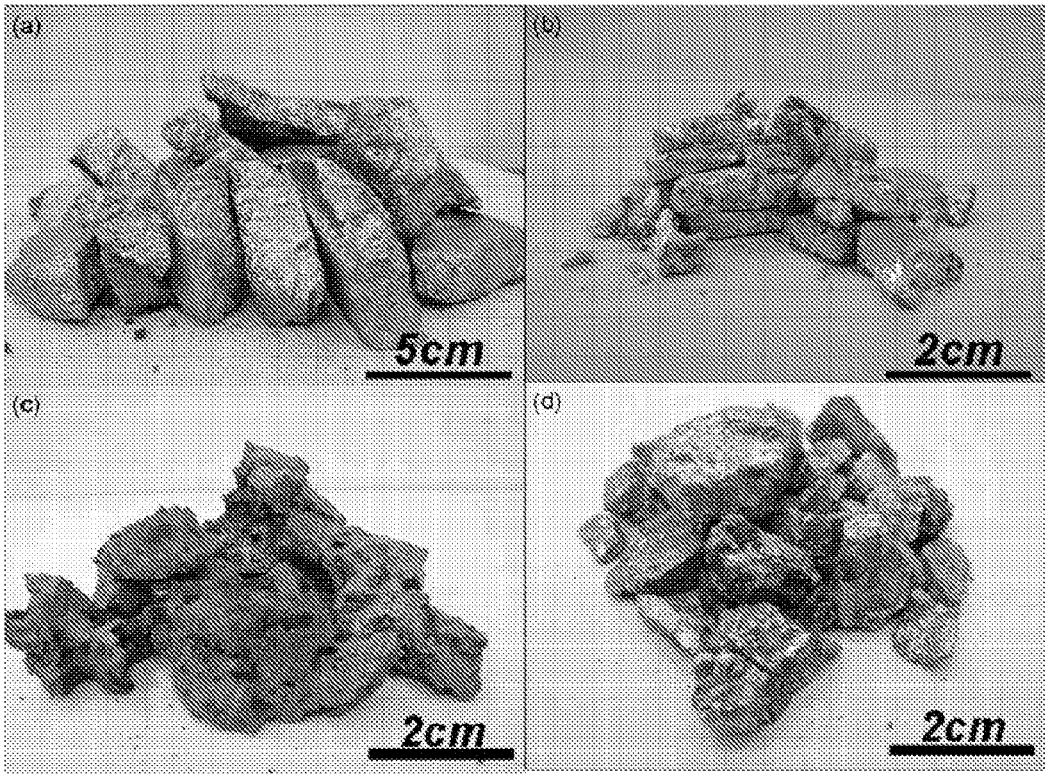
FIG. 4 shows a melting temperature ladder graph, for re-rising temperature in an evaporating and purifying an Mg material of the present invention.

Referring to FIG. 4, the sharp of the Mg-based intermetallic compound of the present invention is shown. FIG. 4(*a*) shows a block of $Mg_2Ni$ of the Mg-based intermetallic compound, FIG. 4 (*b*) shows a block of $Mg_2Cu$ of the Mg-based intermetallic compound, FIG. 4 (*c*) shows a block of $Mg_2Si$ of the Mg-based intermetallic compound, and FIG. 4(*d*) shows a block of $Mg_2Sn$ of the Mg-based intermetallic compound.

From the above, the manufacturing method of the present invention uses the characteristics of the high vapor pressure of the Mg material and easy evaporating process, to perform the third step of evaporating in the melting process. Thus the remained Mg material of the alloy is evaporated to produce the highly pure Mg-based intermetallic compound. The manufacturing method is novel, unobvious, and is valuable in the relating industry (such as, corporations for applying hydrogen, corporations for manufacturing semiconductor, thermal electronic power corporations, etc.).

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method for manufacturing a Mg-based intermetallic compound, comprising steps of:

melting and mixing a predetermined material in a first heating furnace having a sealed chamber filled fully inert gases therein, the predetermined material including an excessive Mg material during melting in the first heating furnace, and a second material having higher melting point being dissolved with the excessive Mg material having a lower melting point to form an uniform melt;

casting the uniform melt on a second heating furnace; and evaporating by cooperating with an evaporating device to evaporate remained Mg material, and then decreasing temperature to obtain the Mg-based intermetallic compound.

2. The method as claimed in claim 1, wherein the predetermined material is selected from a group consisting of a block, a powder, and a porous material.

3. The method as claimed in claim 1, wherein the second heating furnace is a thin and long flat plate.

4. The method as claimed in claim 1, wherein the Mg in the Mg-based intermetallic compound has a mole percentage corresponding to a peritectic reaction of an Mg-based plane phase graph.

5. The method as claimed in claim 1, wherein the evaporating step is performed between a eutectic temperature and a temperature of melting point of the Mg-based intermetallic compound.

6. The method as claimed in claim 1, wherein a third material selected from a group consisting of Al, Fe, Zr, Ti, Cu, Pd, Pt and Ag, is added in a rising temperature process of the evaporating.

7. The method as claimed in claim 1, wherein a third material selected from a group consisting of Al, Fe, Zr, Ti, Cu, Pd, Pt and Ag, is added in a decreasing temperature process of the casting.

8. The method as claimed in claim 1, wherein a third material selected from a group consisting of Al, Fe, Zr, Ti, Cu, Pd, Pt and Ag, is added in a maintaining temperature process of the evaporating.

* * * * *